United States Patent [19]

Kim

[11] Patent Number: 5,067,471

[45] Date of Patent: Nov. 26, 1991

[54] PORTABLE CATAPULT DEVICE FOR HURLING A SUCCESSION OF BALLS FOR BATTING PRACTICE

[76] Inventor: John Y. Kim, 144 S. Whisman Rd., Mt. View, Calif. 94041

[21] Appl. No.: 511,632

[22] Filed: Apr. 20, 1990

Related U.S. Application Data

[63] Continuation-in-part of Ser. No. 247,713, Sep. 22, 1988, abandoned.

[51] Int. Cl.[5] ..... F41B 3/02

[52] U.S. Cl. ..... 124/21; 124/17; 124/35.1; 124/50

[58] Field of Search ..... 124/20.1, 17, 21, 41.1, 124/7, 50, 49, 18, 1, 26, 35.1; 273/26 D

[56] References Cited

U.S. PATENT DOCUMENTS

| | | | |
|---|---|---|---|
| 1,356,466 | 10/1920 | Parsons . | |
| 2,646,785 | 7/1953 | Goldman | 124/21 |
| 2,700,379 | 1/1955 | Brigati . | |
| 3,549,148 | 12/1970 | Schloss | 124/21 X |
| 3,643,643 | 2/1972 | Jordan . | |
| 3,687,453 | 8/1972 | Fraga . | |
| 4,080,950 | 3/1978 | Paulson et al. . | |
| 4,179,123 | 12/1979 | Tsukuda . | |
| 4,197,827 | 4/1980 | Smith . | |
| 4,240,396 | 12/1980 | Randall | 124/17 |
| 4,249,508 | 2/1981 | Keller et al. . | |
| 4,261,319 | 4/1981 | Dixon . | |
| 4,323,047 | 4/1982 | McIntosh et al. . | |
| 4,458,656 | 7/1984 | Giovagnoli . | |
| 4,579,100 | 4/1986 | Whitaker . | |

FOREIGN PATENT DOCUMENTS

| | | |
|---|---|---|
| 2386321 | 11/1978 | France . |
| 2388571 | 11/1978 | France . |
| 2594706 | 8/1987 | France . |
| 2035106 | 6/1980 | United Kingdom . |

*Primary Examiner*—Peter M. Cuomo

*Attorney, Agent, or Firm*—John J. Leavitt; Douglas R. Hanscom

[57] ABSTRACT

Presented is a portable catapult device for hurling a succession of simulated baseballs for the purpose of affording novices in the game of baseball an opportunity to swing at the simulated baseball to thereby increase their proficiency at batting. The device includes a base on which is mounted a carriage that is reciprocable by engagement with an endless chain, and a sling mounted on the base through use of elastic bands selectively connected to and disconnected from one end of the reciprocable carriage so that the elastic bands are stretched a predetermined amount and when released carry a ball-impelling member that engages the ball and impels the ball from the device at a predetermined velocity and in a predetermined trajectory that carries the ball toward the batter.

18 Claims, 12 Drawing Sheets

PORTABLE CATAPULT DEVICE FOR HURLING A SUCCESSION OF BALLS FOR BATTING PRACTICE

BACKGROUND OF THE INVENTION

This application is a Continuation-in-Part of application Ser. No. 07/247,713 filed 09/22/88 now abandoned.

1. Field of the Invention

This invention relates to ball propulsion devices, and particularly to a portable device for hurling low-mass simulated baseballs for the purpose of batting practice.

2. Description of the Prior Art.

It has long been recognized that one of the most difficult functions to perform as a member of a baseball team is to hit a pitched ball. This function requires coordination of the entire body, particularly the arms, wrists and the eyes. Many different types of ball throwing or propelling machines have been devised, but none appear to be as simply constructed and as portable as the catapult device forming the subject matter of this invention. Additionally, most of the machines for throwing a ball that are represented by the prior art constitute large and expensive machines that lack portability and include complexities beyond the ken of the usual baseball enthusiast.

To engender enthusiasm for baseball, particularly in young people, it is important that such young people be introduced to the game, particularly to the function of batting the ball, in a manner that will instil confidence in the youth instead of fear that he will be hit by the ball. Accordingly, it is one of the objects of the present invention to provide a catapult device for propelling a simulated baseball at such a velocity and over a predetermined trajectory so that a youthful trainee may practice keeping his eye on the ball while batting at it with a baseball bat.

Proficiency in the performance of many activities requires that the performer practice consistently. Most ball throwing apparatuses are of a commercial nature, and are mounted in playgrounds in the out-of-doors, where inclement weather may frequently prevent their use. Accordingly, another object of the present invention is the provision of a catapult device for propelling a simulated baseball indoors without the danger of the simulated ball damaging the interior of the premises.

I have found that it is possible to train oneself to keep his eye on a fast moving ball if such ball is repeatedly presented to him at a relatively constant velocity and over a predetermined trajectory. Accordingly, another object of the invention is the provision of a catapult device that will propel a simulated baseball at a predetermined velocity and over a predetermined trajectory.

One of the elements that determines whether or not a person may keep his eye on the ball as it is moving toward him is the length of time that it takes the ball to travel the distance between the propelling device and the location of the batter. Accordingly, another object of the invention is the provision of a catapult device in which the velocity at which the ball travels may be varied by varying the force with which it is impelled.

Still another object of the invention is the provision of a catapult device that is effective in propelling a simulated baseball varying distances selectable by the batter.

Still another object of the invention is the provision of a catapult device for propelling simulated baseballs which is relatively inexpensive to manufacture, thus making it available to every household for use within a house by relatively young baseball trainees.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the portable catapult device for hurling a succession of balls for batting practice comprises a base member for supporting the device and which is completely portable even by a child. Mounted in association with the base is a hopper or container, preferably funnel-shaped, for storing until use a multiplicity of simulated baseballs which are adapted to be hurled through space individually at a predetermined velocity and over a predetermined trajectory in timed succession. Mounted on the base member is a carriage that is reciprocable along the longitudinal axis of the base member between first and second extreme positions. Mounted on the base member in association with the first extreme position to which the carriage is moved is a sling that is resiliently mounted on the base member and which includes a plurality of at least three elastic members or bands all lying in a common plane transverse to the longitudinal axis. When the carriage is moved to the first extreme position, means are provided on the carriage for engaging the sling. Thereafter, movement of the carriage toward the second extreme position elastically stretches the elastic bands uniformly and pulls them out of the common plane. Means are provided interacting with the rearward movement of the carriage to release one of the balls contained in the hopper and to place it and retain it in position to be impelled by the sling. When the carriage reaches the second extreme position, the elastic members of the sling have now been stretched to a predetermined limit, and means on the carriage operate to release the sling from the carriage, thus causing the sling to be pulled forward rapidly by the power of accommodation in the elastic members and in so doing to impact with the simulated ball and propel the ball at a predetermined velocity through a predetermined trajectory.

DESCRIPTION OF THE PREFERRED EMBODIMENT

Figure 1:
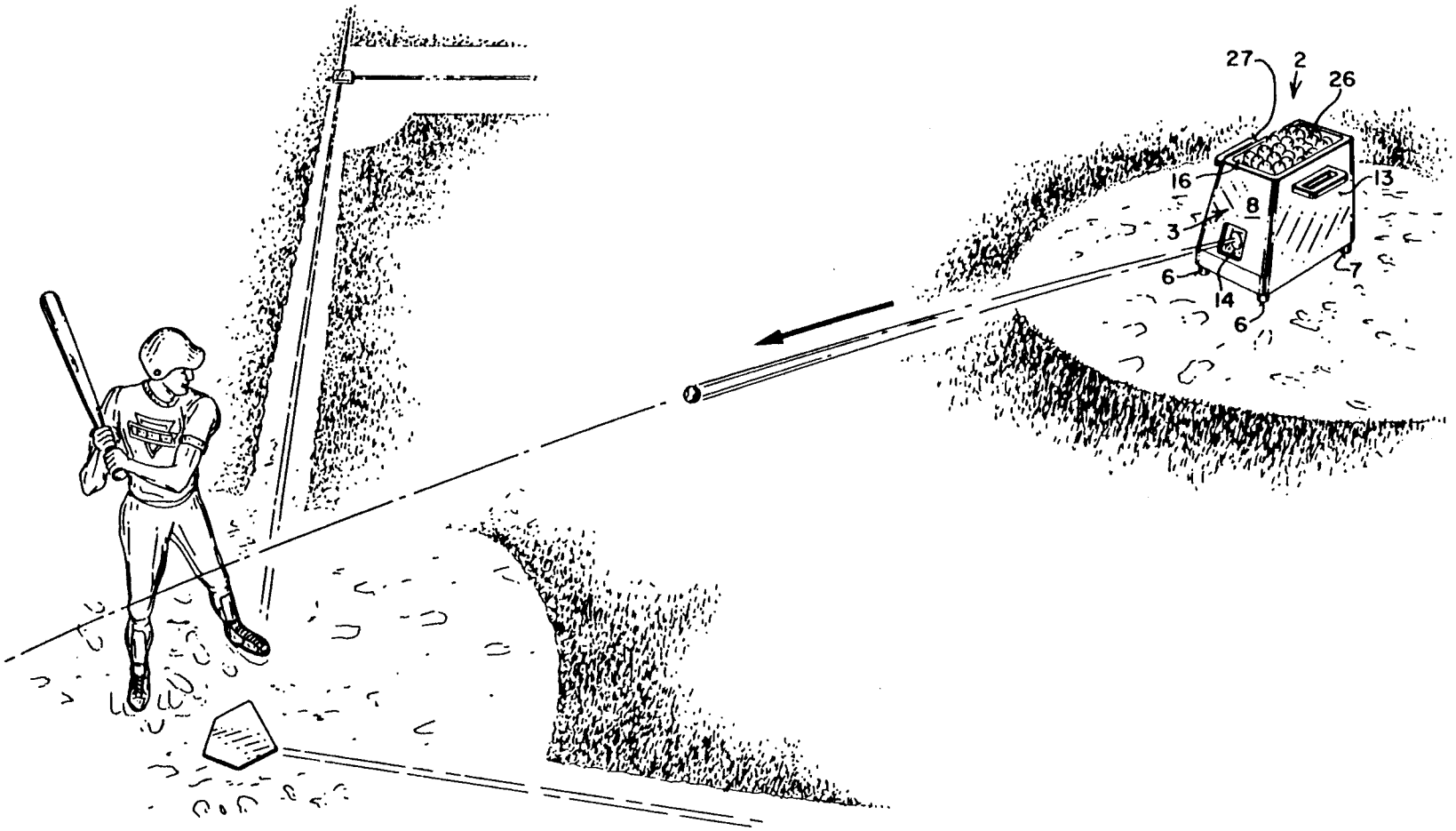
FIG. 1 is a perspective view illustrating the manner of use of the portable catapult device.
Figure 2:
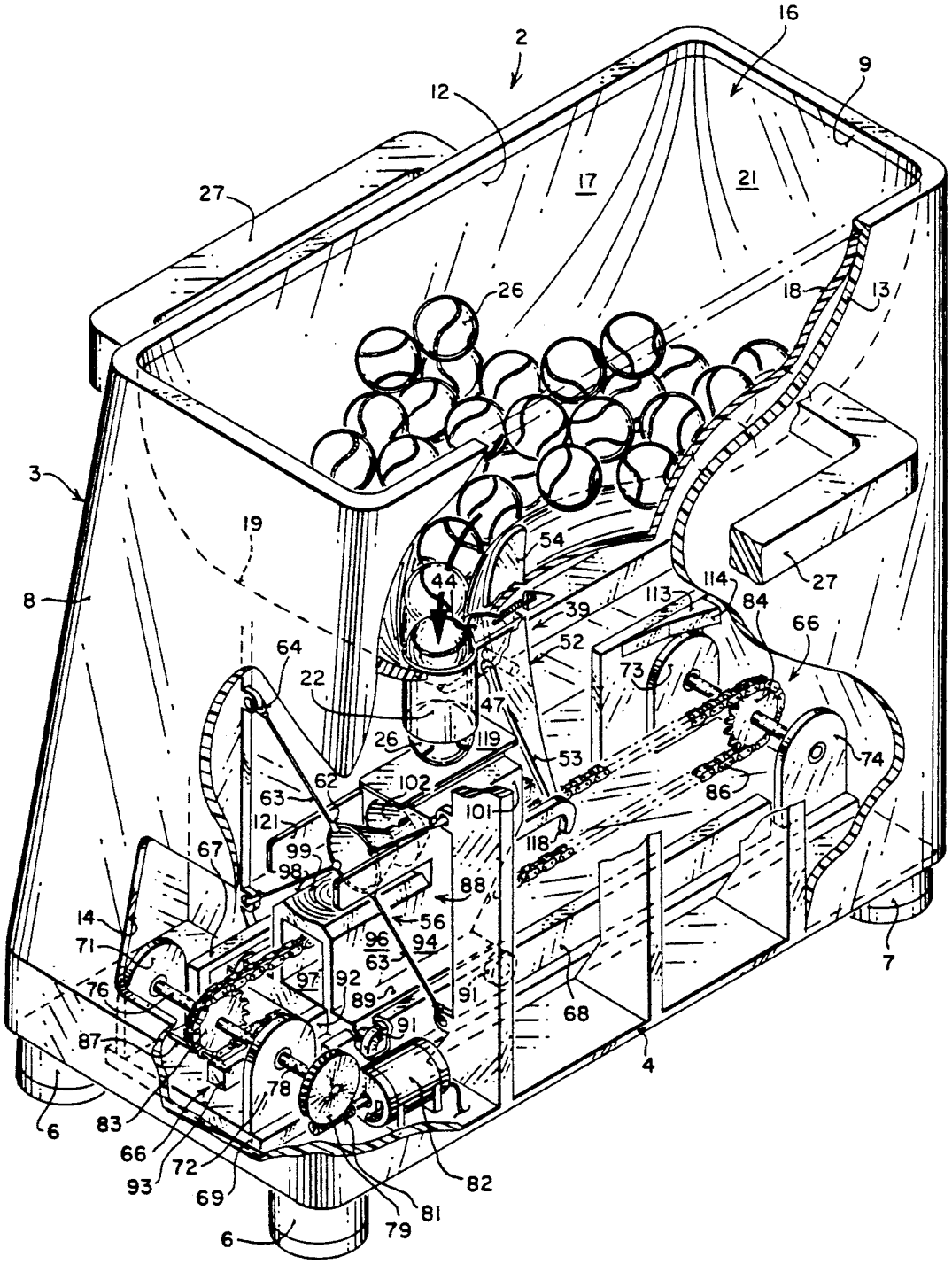
FIG. 2 is a perspective view of the portable catapult device, portions of the housing being broken away to reveal the internal construction. The sling is shown in its static position in which the elastic members all lie in a common plane.

In terms of greater detail, the portable catapult device for hurling a succession of balls for batting practice is designated generally by the numeral 2 and comprises a base member designated generally by the numeral 3 and including a bottom wall 4 having attached thereto two pairs of foot members 6 and 7 associated, respectively, with the front and back ends of the device. While I have illustrated the foot members as being of equal elevation, it is obvious that an adjustment in the elevation of the foot members 6 may be made in order to cant the device to modify the trajectory of the ball as it is flung from the device.

The base member also includes a front wall 8, a rear wall 9, and left and right side walls 12 and 13, as viewed from the front of the device. As illustrated in the drawings, the front wall 8 is provided with a sizable aperture 14 through which balls are propelled from the device. In this respect, note that the device is provided with a hopper designated generally by the numeral 16, the hopper being generally rectangular in conformity with the upper end of the device, having left and right side walls 17 and 18, respectively, and end walls 19 and 21, respectively, associated with the front and rear walls of the base member. As illustrated in FIGS. 2–6, the walls of the hopper 16 converge into and communicate with a generally cylindrical delivery tube designated generally by the numeral 22, having an inlet end 23 communicating directly with the interior of the hopper 16, and an outlet end 24 through which individual balls 26 normally contained in the hopper are delivered through the delivery tube to be positioned to be flung from the device as will hereinafter be explained. To facilitate carrying the catapult device from one location to another, be it indoors or outdoors, the side walls 12 and 13 are provided with carrying handles 27 as illustrated. It will of course be understood that while I have illustrated a specific exterior configuration for the device, other configurations may be utilized without departing from the definition thereof provided by the appended claims.

Within the hollow interior formed by the front, rear and side walls of the base member, reinforcement ribs 28, 29 and 31 are provided associated with the side wall 12, while reinforcement ribs 32, 33 and 34 are associated with the side wall 13 as shown. In a base member that may be injection molded from an appropriate synthetic resinous material, these reinforcement ribs may be integrally formed with the side walls with which they are associated. On the other hand, if some other appropriate material is utilized to fabricate the base member, the reinforcement ribs may be attached in any suitable manner. As illustrated, the reinforcement ribs are spaced longitudinally along the respective side walls of the base member, and are spaced laterally on opposite sides of a longitudinal axis 36, equally spaced between the side walls 12 and 13 as viewed in FIGS. 7–9, and elevated above the bottom wall 4 as illustrated in FIGS. 3–6, the axis 36 generally being centrally disposed with respect to the aperture 14 through which the balls 26 are propelled. It will also be noted that the longitudinal axis 36 is spaced below the outlet end 24 of the delivery tube 22 as illustrated in FIGS. 3–6.

Referring to FIGS. 2–6, it will be seen that the side walls of the hopper converge funnel-like so as to coincide with the inlet end 23 of the delivery tube 22. It will also be seen that the extension of the rear wall 21 of the hopper is designated generally by the numeral 37 and forms an inclined bottom for the hopper, the bottom wall 37 adjacent the inlet end 23 of the delivery tube 22 having a slot 38 formed therein. To provide reinforcement for the ball delivery tube 22, and also to function as a mounting platform for a ball metering assembly designated generally by the numeral 39, there is provided a gusset plate 41 extending horizontally between the ball delivery tube 22 and the rear wall 9 of the base member as illustrated in FIGS. 3–6. The gusset plate is attached at one end to the rear wall 9 and at its opposite end is attached to the ball delivery tube 22 as shown.

The gusset plate, in the region next adjacent the ball delivery tube 22, is provided with a projection 42 to which is attached one end of a spring 43, the other end of which is connected to a ball metering plate 44 pivoted about an axis 46 on an appropriate shaft 47 journaled for pivotal rotation on the gusset plate 41 next adjacent the ball delivery tube 22 as shown. The metering plate 44 includes a concave recess 48, while the ball delivery tube 22, particularly the wall thereof next adjacent the gusset plate 41, is provided with a slot 49 through which the metering plate 44 may pivot. The metering plate 44 is also provided with an upper convex edge 51 which is positioned in FIGS. 3, 5 and 6 so as to intercept a ball 26 and prevent its passage through the ball delivery tube 22.

Figure 3:
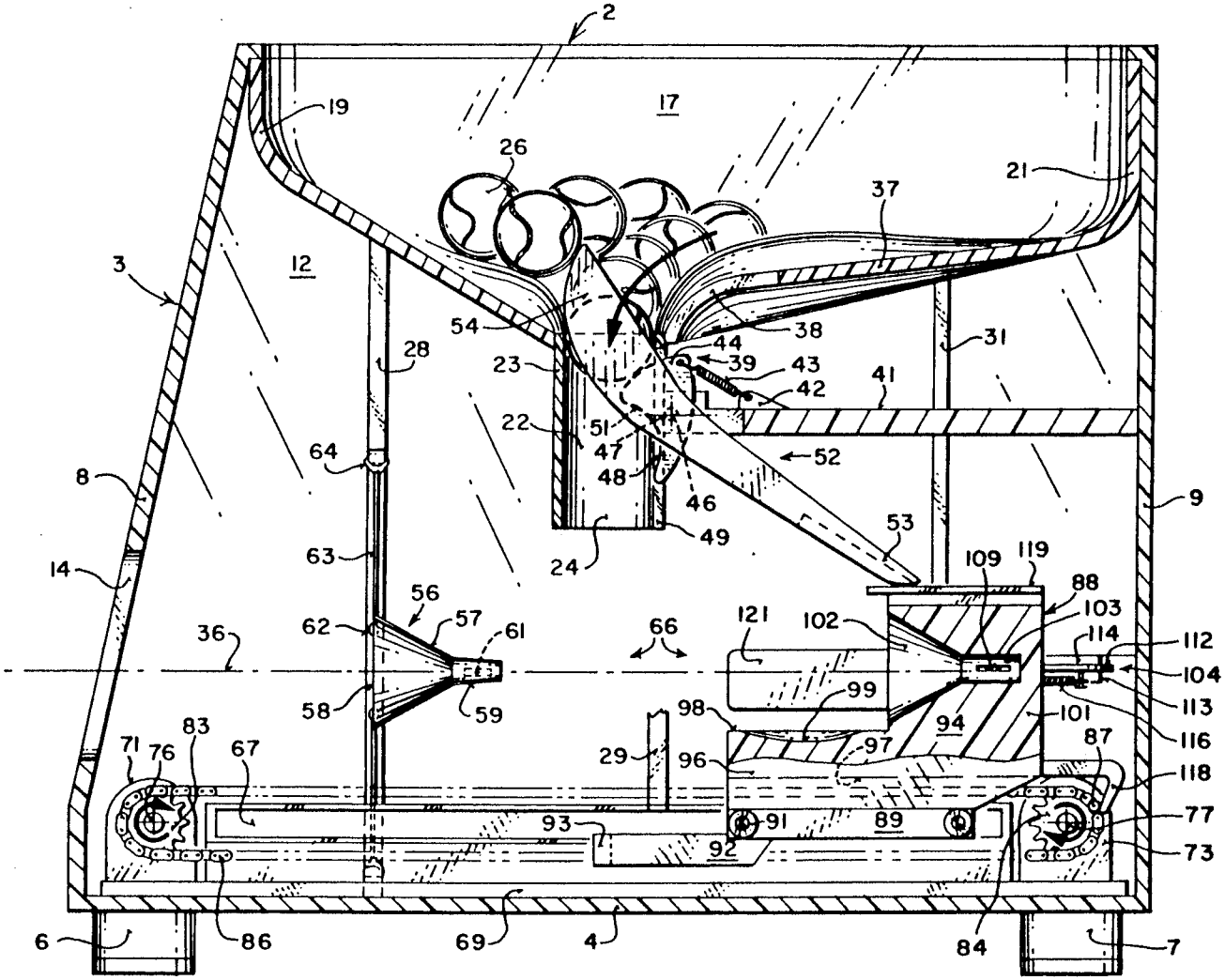
FIG. 3 is a vertical cross-sectional view through the longitudinal axis of the portable catapult device, showing the carriage at its rearmost extreme position, the ball metering device positioned to retain the balls in the hopper, and the elastic bands all lying in a common plane.
Figure 4:
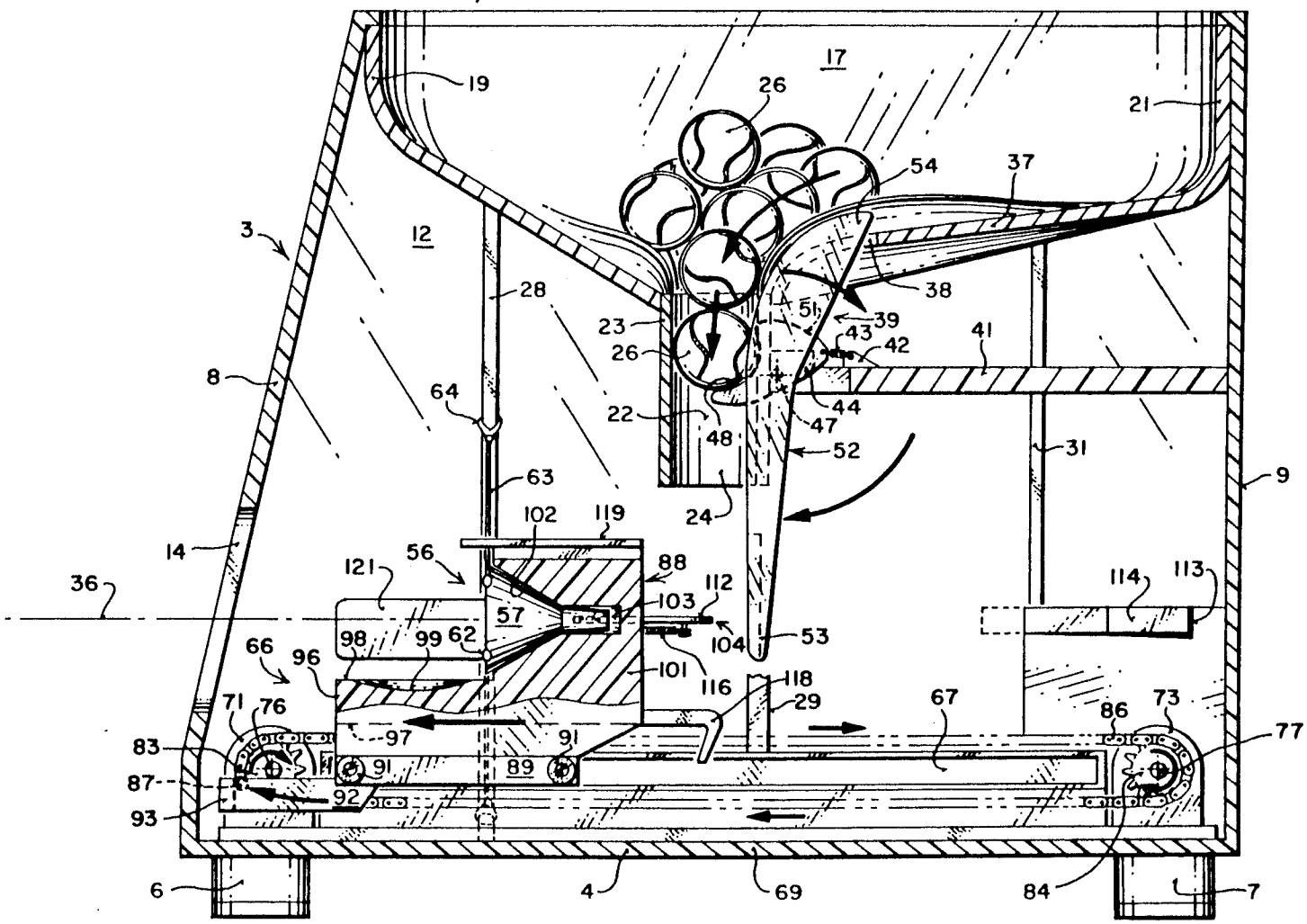
FIG. 4 is a vertical cross-sectional view through the longitudinal axis of the device and showing the carriage at its forwardmost position, with the metering device now shifted to engage a ball in preparation of delivering the ball into position to be impelled. The sling is shown in its static position in which the elastic bands all lie in a common plane.
Figure 5:
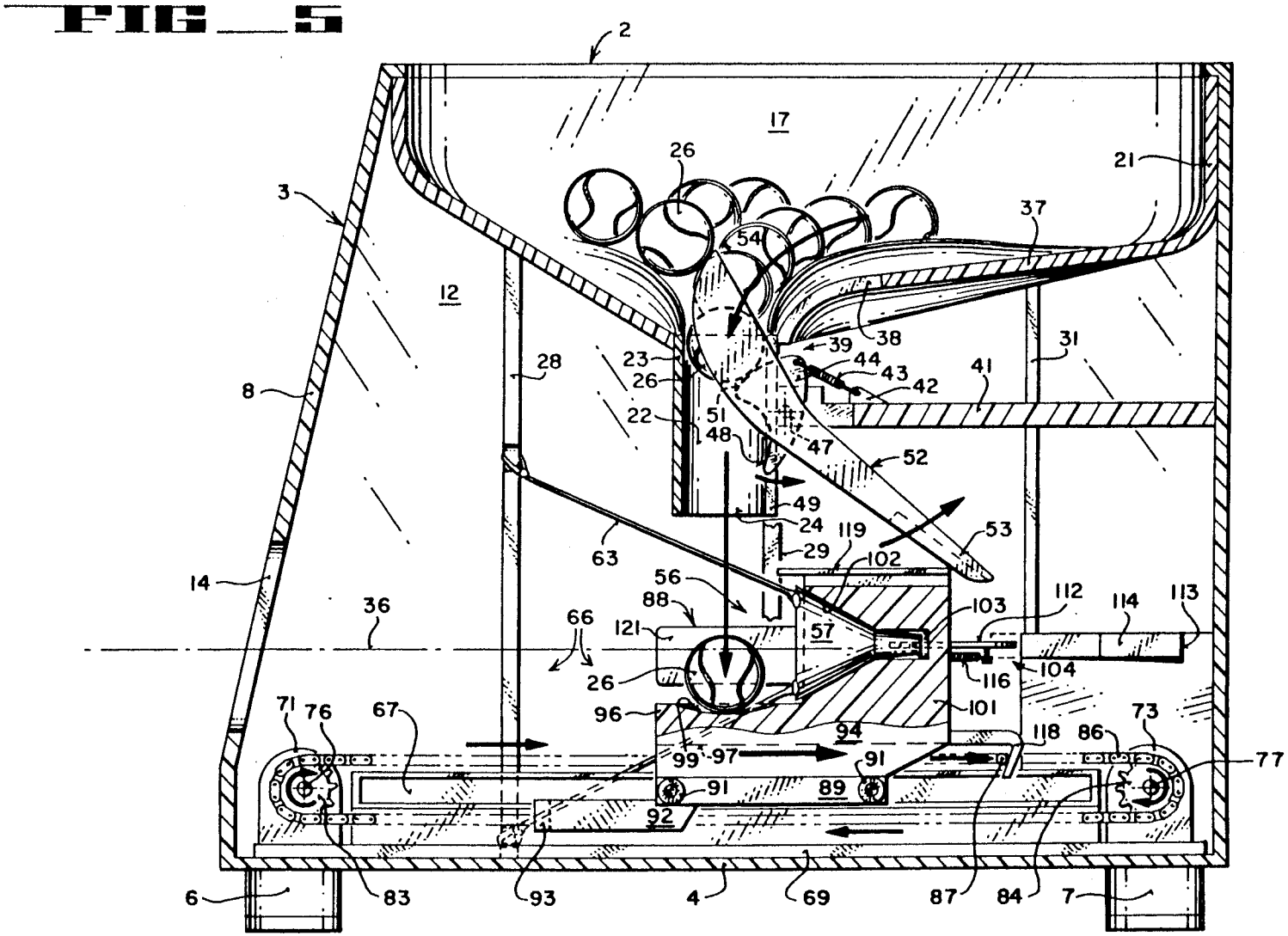
FIG. 5 is a vertical cross-sectional view taken through the longitudinal axis of the device and illustrating the carriage in a rearwardly moving intermediate position with a ball now delivered by the metering device to a position on the carriage from which it may be impelled, and the plurality of elastic bands stretched out of the common plane in which they lie coincident with the extreme forward position of the carriage.
Figure 6:
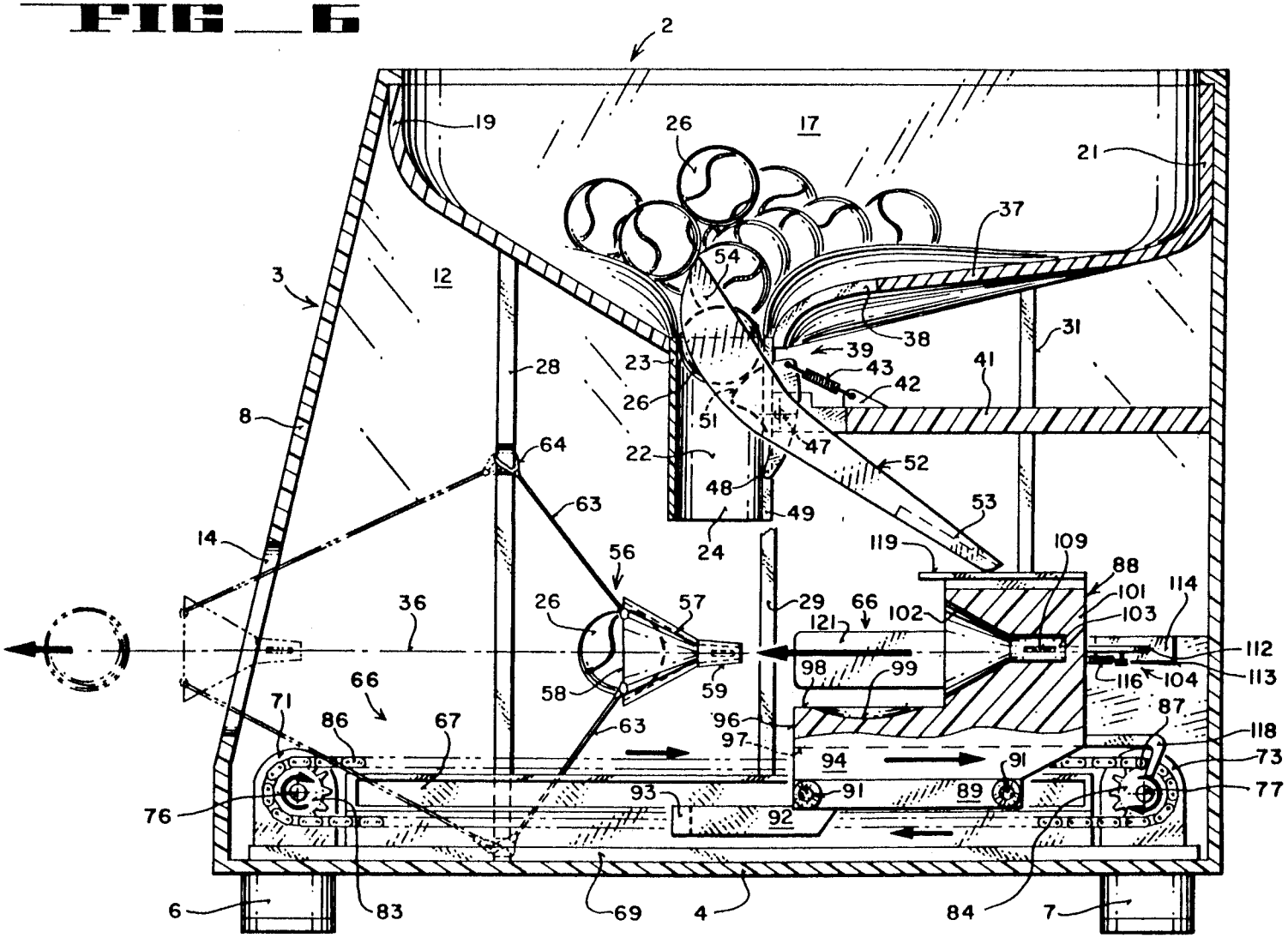
FIG. 6 is a vertical cross-sectional view taken through the longitudinal axis of the device, showing the carriage near its rearmost extreme position and the sling released from the carriage and moving forwardly to impel the ball.

The metering plate 44 is connected directly through the shaft 47 with a metering control plate 52 having a tail-end portion 53 and a head-end portion 54 that projects into the bottom of the hopper immediately adjacent the outer periphery of the ball delivery tube 22 and thus, in the projected position illustrated in FIGS. 3, 5 and 6, the head-end portion 54 of the metering control plate 52 functions to divert the balls from the sloping bottom walls of the hopper into the inlet end 23 of the ball delivery tube 22. The extremes of movement of the ball metering assembly 39 are illustrated in FIGS. 3 and 4, while intermediate positions of the ball metering assembly are illustrated in FIGS. 5 and 6.

Referring to FIG. 4, it will be seen that with the metering control plate arm 52 in the position illustrated, with the tail portion 53 depending substantially vertically, the metering plate 44 has been pivoted clockwise, placing the concave edge 48 in position to receive a ball 26 and cradle the ball within the ball delivery tube 22. Progressing from FIG. 4 to FIG. 5, it will be seen that counterclockwise pivotal rotation of the control arm 52 causes counterclockwise rotation of the metering plate 44 with attendant withdrawl of the concave supporting edge 48 from beneath the ball, thus causing it to fall by gravity out of the outlet end 24 of the ball delivery tube 22. The manner in which the ball is received and retained in preparation to be flung from the device will be explained hereinafter. Concomitantly with counterclockwise rotation of the metering plate 44 to release the ball that is supported in the concave pocket formed on the edge of the plate, the upper convex metering plate edge 51 moves counterclockwise and is interposed in the ball delivery tube 22 in such a way as to prevent the next succeeding ball 26 from dropping through the ball delivery tube. Continued counterclockwise pivotal rotation of the control arm 52 as illustrated in FIGS. 3 and 6 continues to retain the next succeeding ball 26 trapped in the ball delivery tube 22 and prevents its release.

Referring again to FIG. 4, it will be seen that in the position of the ball metering assembly there depicted, the spring 43 has been substantially collapsed and exerts only a sufficient rotational moment on the metering plate 44 to prevent the weight of the ball 26 from causing counterclockwise rotation of the metering plate. In this regard, the spring is aided by the weight of the depending tail portion 53 of the metering plate control arm 52. Thus, it requires the exertion of force on the tail portion 53 of the control arm to effect a pivotal counterclockwise rotation of the metering assembly into the position illustrated in FIGS. 5 and 6. When such force is imposed, as will hereinafter be explained, the spring 43 is tensioned, imposing a clockwise rotational moment on the metering plate 44 about its rotational axis 46, and tending to bring the concave edge portion 48 of the metering plate back into position to receive the next succeeding ball.

To propel the ball 26 from the device as it is fed into appropriate position, there is provided within the hollow interior of the base member a resilient and elastic sling designated generally by the numeral 56. As shown in the drawings, the sling 56 includes a centrally disposed ball-impelling unit 57 which in the embodiment of the invention illustrated constitutes a funnel-shaped member the large open end 58 of which faces forwardly toward the aperture 14, while the side walls converge conically from the open end 58 toward the funnel spout 59. Formed in the funnel spout 59 is a slot 61 for purposes which will hereinafter be explained. The open end 58 of the funnel 57 is attached to the inner converging ends 62 of four elastic bands 63 of equal length, the opposite ends 64 of which are anchored to the base member, specifically to opposed reinforcement ribs 28 and 32. While I have illustrated the cone-shaped impelling member 57 with a spout portion 59 having a slot 61 therein, it is contemplated that the spout 59 may be omitted, and the slot 61 formed in the conical wall of the cone-shaped member for the same purpose.

Figure 12:
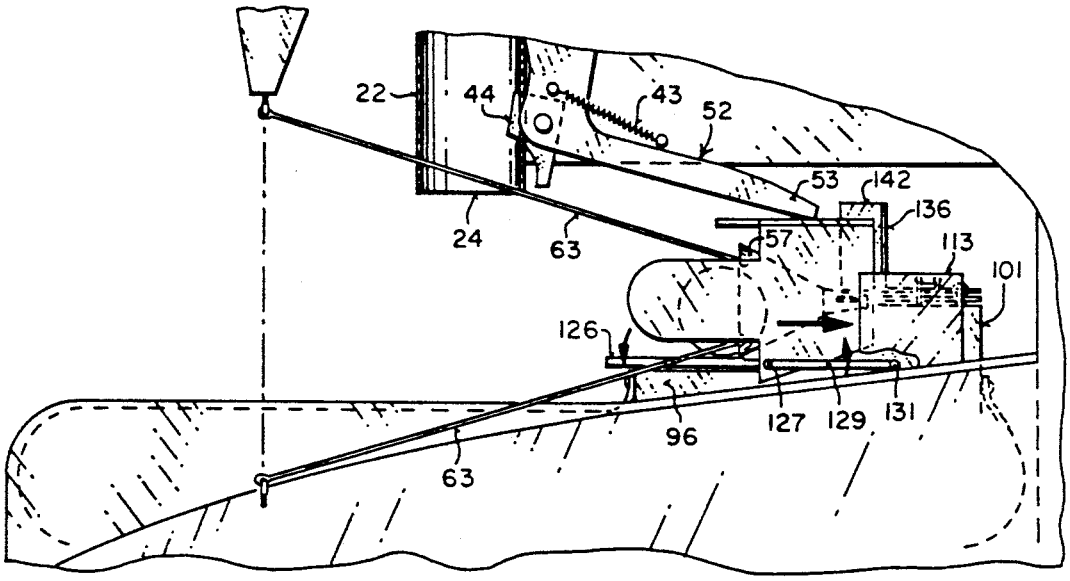
FIG. 12 is a fragmentary elevational view similar to FIG. 11 but showing the carriage at its rearmost position just prior to release of the sling and with the ball-retaining ramp completely retracted.
Figure 13:
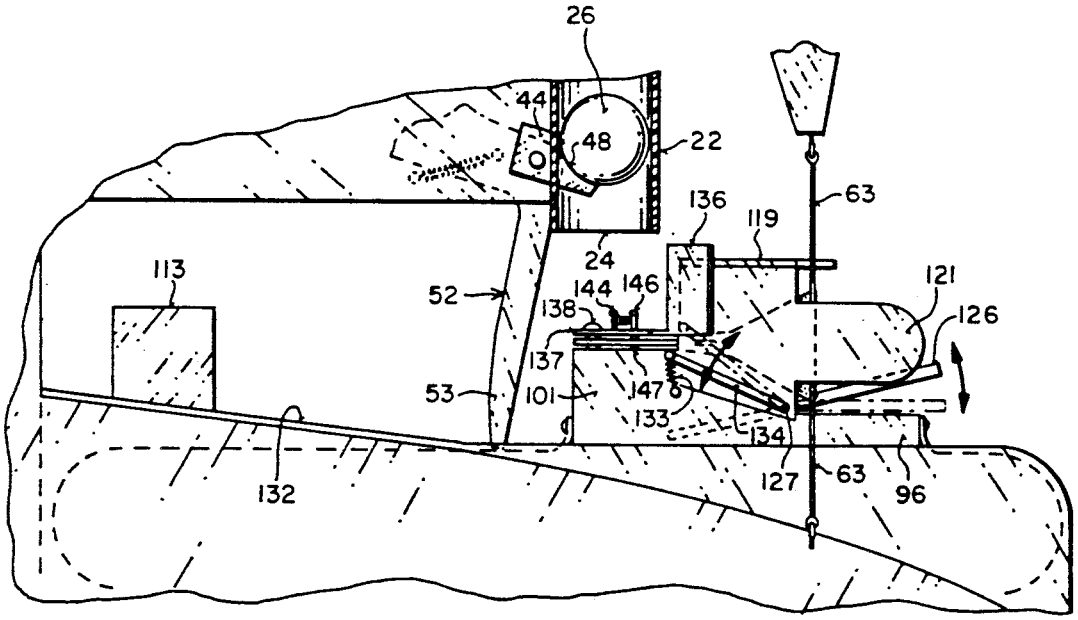
FIG. 13 is a fragmentary elevational view similar to FIG. 10 but showing the carriage from the opposite side and the ball-retaining ramp deployed into ball-retaining position.

As illustrated in the drawings, the attachment points 64 of the elastic band 63 are symmetrical with respect to the central axis 36. This is important because it is desirable that the same amount of power of accommodation exist in each of the elastic bands as the cone-shaped ball impelling element 57 is drawn rearwardly from the static position illustrated in FIGS. 3, 4, 7, 10 and 13, to the positions illustrated in FIGS. 5, 8 and 12. Thus, when drawn to its rearmost position as illustrated in FIGS. 5, 8 and 12, the ball impelling element 56 is axially aligned with the axis 36, and when released as illustrated in FIGS. 6 and 9, will travel a straight path coincident with the axis 36 so that the ball 26 will consistently travel a predetermined path.

To effect withdrawl of the ball impelling element 57 from the position illustrated in FIGS. 3, 4, 7, 10 and 13 to the positions illustrated in FIGS. 5, 8 and 12 there is provided on the base member a carriage assembly designated generally by the numeral 66 which will hereinafter be described. The metering assembly 39 and the sling 56 operate in cooperation with the carriage assembly 66. The carriage assembly includes a guide track comprised of elongated channel members 67 and 68 fixed symmetrically adjacent opposite transverse edges of a base plate 69 suitably secured to the bottom wall 4. Preferably, a median plane passing vertically through the base plate 69 in a longitudinal direction includes a central axis 36 as shown, and the channel members are equally spaced on opposite sides of said plane. For facility in assembly, the channel members may be suitably secured, as by appropriate screws (not shown) to the base plate, in a mutually facing orientation as shown, and the base plate in turn similarly secured as by appropriate screws (not shown) to the bottom wall.

Mounted on the base plate adjacent opposite ends thereof are two pairs of bearing blocks 71–72 and 73–74. Rotatably journaled in the pair of bearing blocks 71–72 is a shaft 76, while rotatably journaled in the pair of bearing blocks 73–74 is a shaft 77. The shafts 76 and 77 are parallel, but at opposite ends of the base plate, and extend transversely thereacross. The shaft 76 extends through the bearing block 72 in a cantilever portion 78 on the end of which is fixed a worm gear 79 adapted to be driven by a worm shaft 81 driven by an electric motor 82 mounted on the base member. Activation of the motor thus effects rotation of the shaft 76. Mounted on the shaft 76 midway between the bearing blocks 71–72 for rotation with the shaft 76 is a sprocket 83. Mounted on shaft 77, also midway between the bearing blocks 73–74, and aligned with sprocket 83, is a similar sprocket 84, also fixed for rotation with the associated shaft 77. An endless chain 86 connects the two sprockets 83 and 84 as shown. Thus, rotation of shaft 76 by the motor 82 effects rotation of the shaft 77. Mounted on one link of the chain is at least one cross-pin 87 the opposite end portions of which project on opposite sides of the chain for purposes which will hereinafter be described.

The carriage assembly 66 also includes a carriage 88 adapted to rollably reciprocate on the elongated guide track comprised of channel members 67 and 68. The carriage 88 includes a flat generally rectangular support plate portion 89 having wheels 91 mounted on lateral edges adjacent the four corners of the support plate as shown. The width of the support plate is proportioned so that the support plate is accommodated between the spaced, parallel and mutually facing channel members 67 and 68, and the wheels 91 are proportioned for and are enclosed within the opposed channel members whereby longitudinal rollable reciprocation of the carriage 88 is guided by the cooperative interaction of the wheels and channel members.

Mounted on the lower side of the support plate 89 is a forwardly projecting cantilever beam 92 having a hook portion 93 (FIGS. 2, 7, 8 and 9) mounted thereon and extending laterally toward the lower reach of chain 86 to a position where it may be engaged by the cross-pin 87 as it travels forwardly on the lower reach of the chain. Thus, at an appropriate time in the cycle of the device, the hook portion 93 is engaged by the cross-pin 87 and the support plate is rollably drawn forward by the chain-mounted cross-pin until the support plate reaches the forward limit of its reciprocation (FIGS. 2, 4 and 7) at which point the cross-pin is elevated and carried around the sprocket 83 to the upper reach of the chain and the hook portion and cross-pin are disengaged, leaving the carriage at its forwardmost position awaiting re-connection with the cross-pin, now carried on the upper reach of the chain and moving rearwardly toward the rear sprocket 84.

Also mounted on the flat support plate portion 89 is a main body portion designated generally by the numeral 94. The main body portion includes a forwardly projecting block portion 96 having a passageway 97 therethrough to accommodate passage of the upper reach of the chain and, of course, the cross-pin when carried by the upper reach of the chain. The top surface 98 of the block portion in the embodiment illustrated in FIGS. 2–9 is recessed to provide a ball-receiving and retaining shallow pocket 99, as shown, for a purpose which will hereinafter be explained. The main body portion of the carriage also includes a rear block portion 101 that projects upwardly above the top surface 98 of the forward block portion 96 as shown.

The rear block portion is centered in relation to the longitudinal axis 36, and is formed with a recess 102 that conforms substantially to the conical configuration of the ball-impelling member 57 and the funnel spout 59. Thus, when the carriage is in its forwardmost position as illustrated in FIGS. 4, 7, 10 and 13, the cone-shaped ball impeller 57 is nested in the recess 102 and centered in relation to the axis 36. The conical recess 102 is formed with a recess extension 103 to accommodate the spout 59 of the ball impeller.

To releasably lock the sling 56 to the carriage assembly 66 when the carriage assembly has reached its forwardmost position as illustrated in FIGS. 4, 7, 10 and 13, there is provided pivotally mounted on the carriage, and more specifically on the rear block portion 101 thereof, a spring-pressed latch assembly designated generally by the numeral 104. The latch assembly is pivotally mounted by a pivot pin 106 on a stepped-down surface 107 of the rear block portion, and includes a pivotal latch arm 108 having a hook portion 109 on one end. The latch assembly also includes an extension of the pivotal latch arm 108 on the opposite side of the pivot 106. This extension constitutes a latch arm actuator portion 112 adapted to cooperatively interact with a cam block 113 having a cam surface 114 thereon against which the latch arm actuator portion 12 is adapted to slidably impinge.

Figure 7:
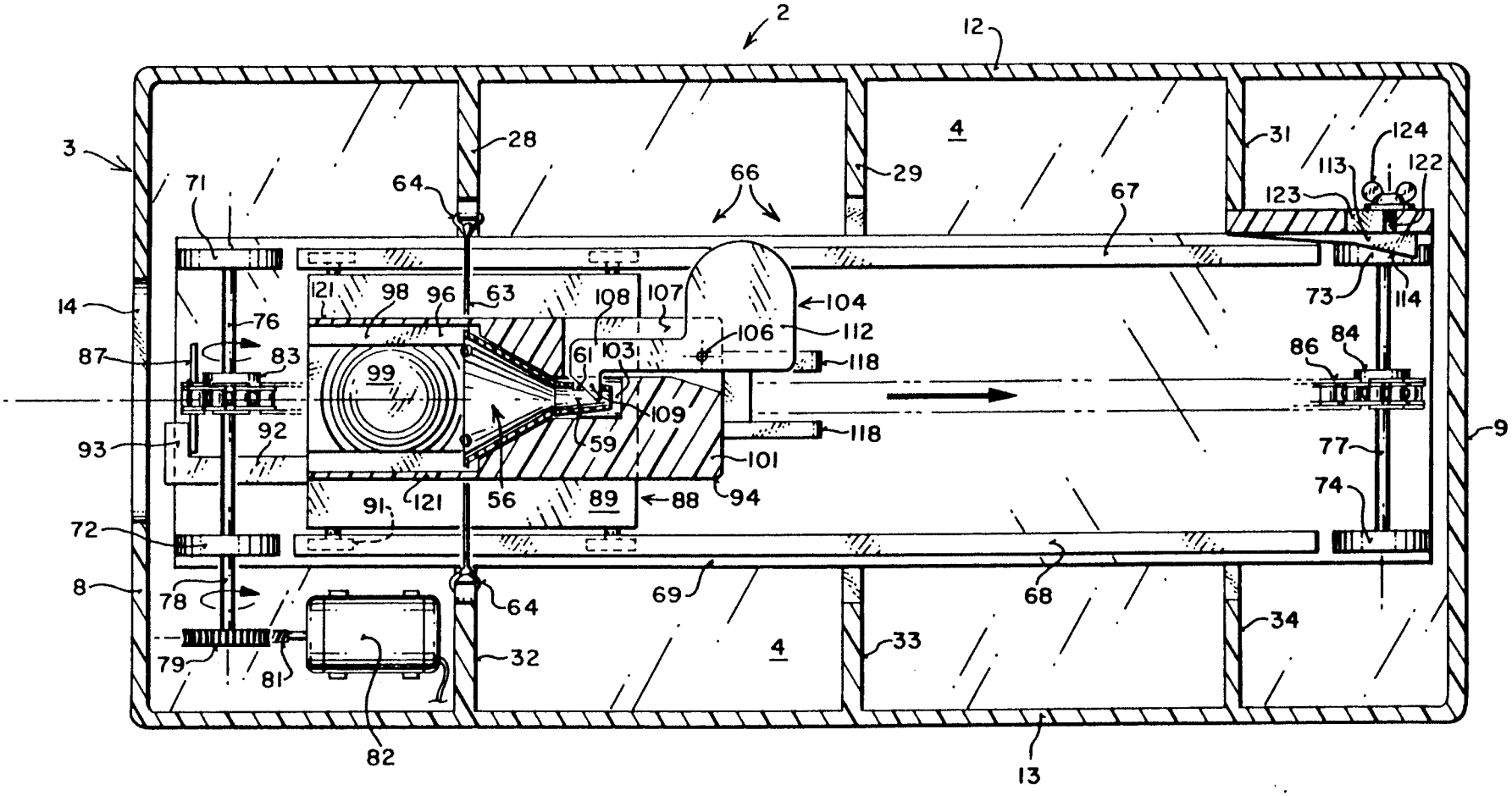
FIG. 7 is a horizontal cross-sectional view through the longitudinal axis of the device and illustrating the manner of detachable attachment of the ball-impelling portion of the sling to the reciprocable carriage when the carriage is in its first or forward extreme position and the sling is unstressed in a static condition.
Figure 8:
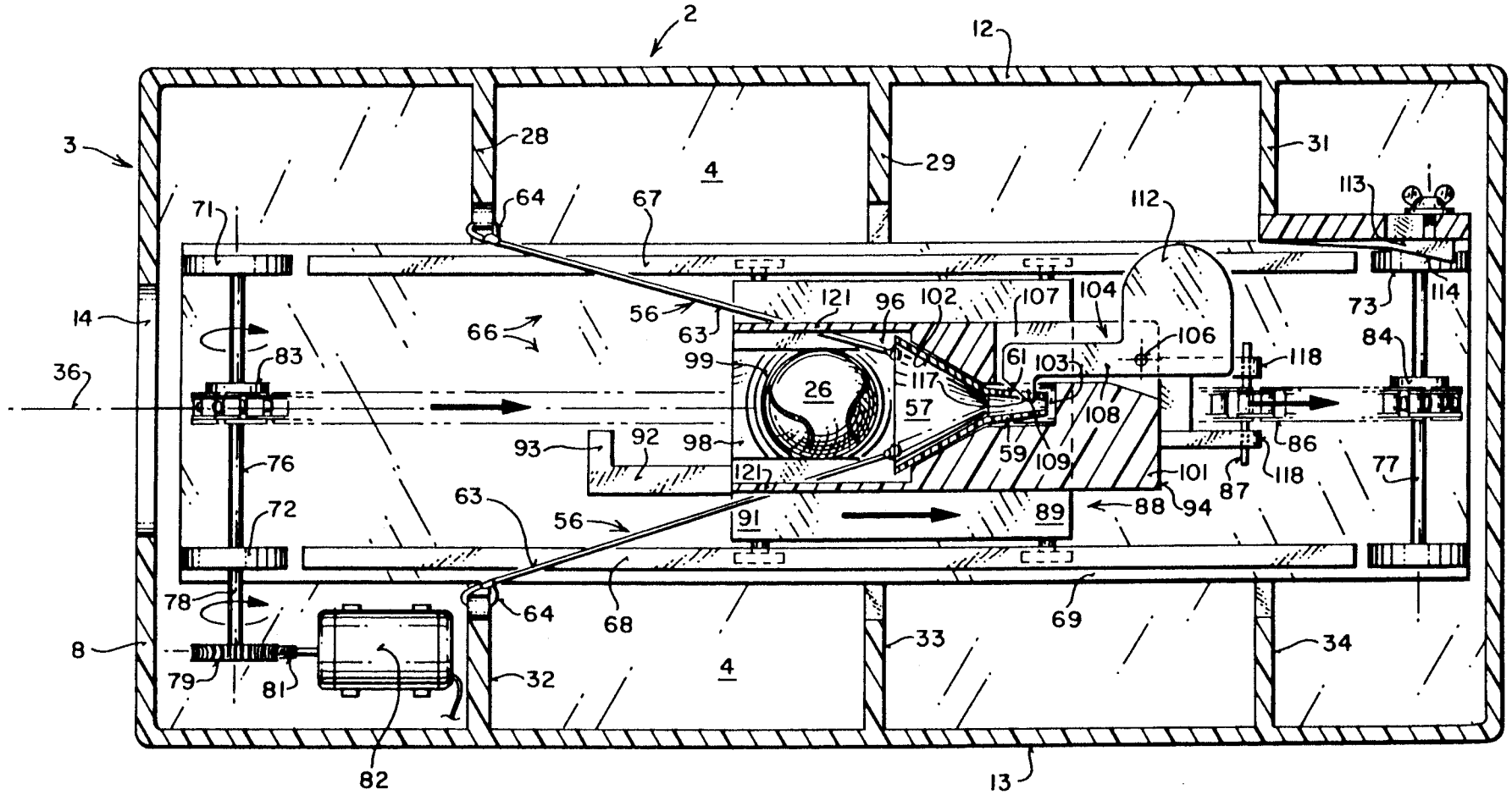
FIG. 8 is a horizontal sectional view taken through the longitudinal axis of the device and showing the carriage retracted in the direction of its rearmost or second extreme position and showing the manner in which the plurality of elastic bands of the sling are elastically stretched uniformly so as to enable the ball-impelling portion of the sling when released to impact with a ball and propel it through a predetermined trajectory.
Figure 9:
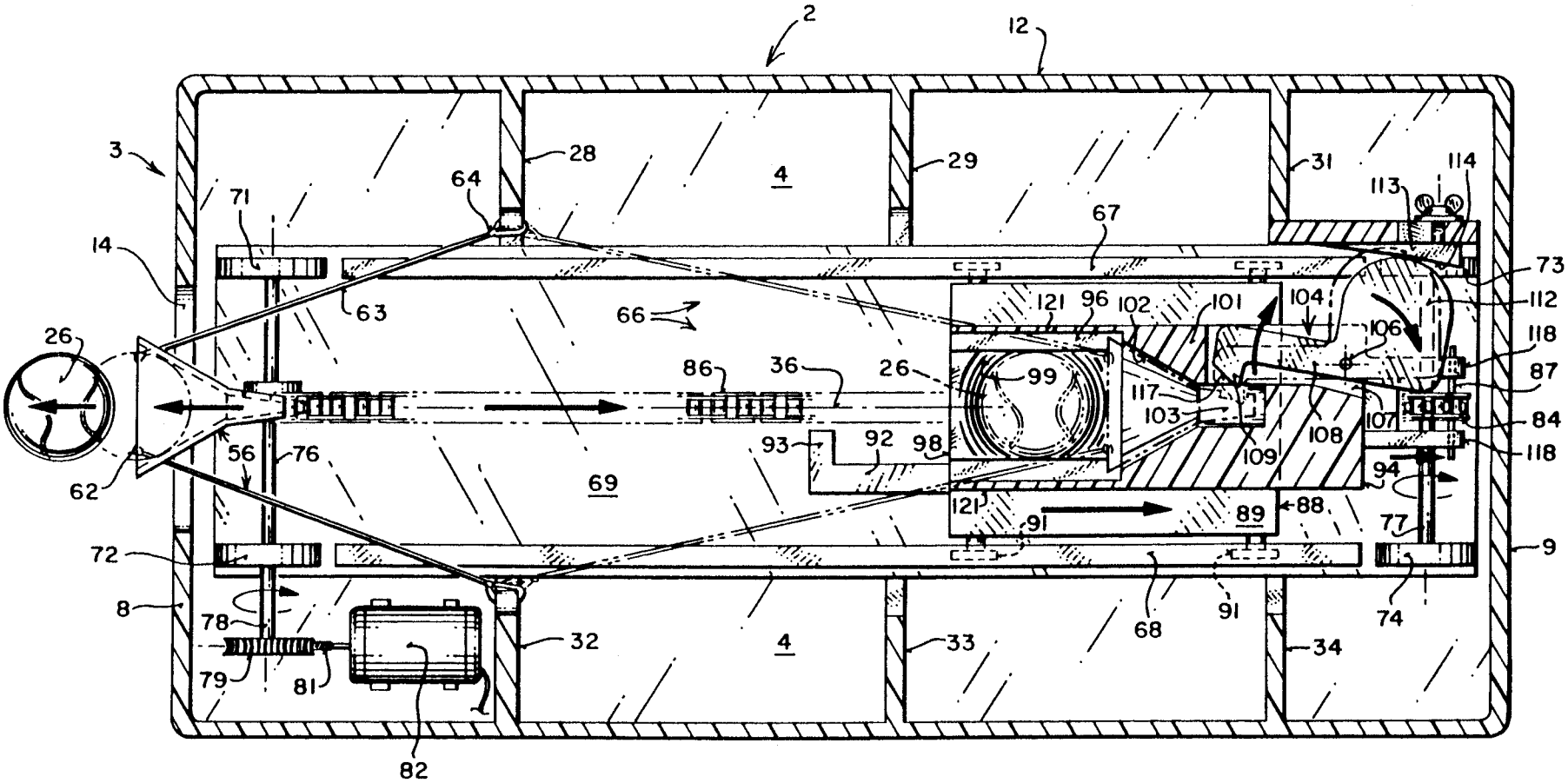
FIG. 9 is a horizontal cross-sectional view taken through the longitudinal axis of the device and illustrating the position of the sling at its forwardmost dynamic position beyond its static position after the ball has been impelled and just prior to elastic return of the sling to its static position.
Figure 10:
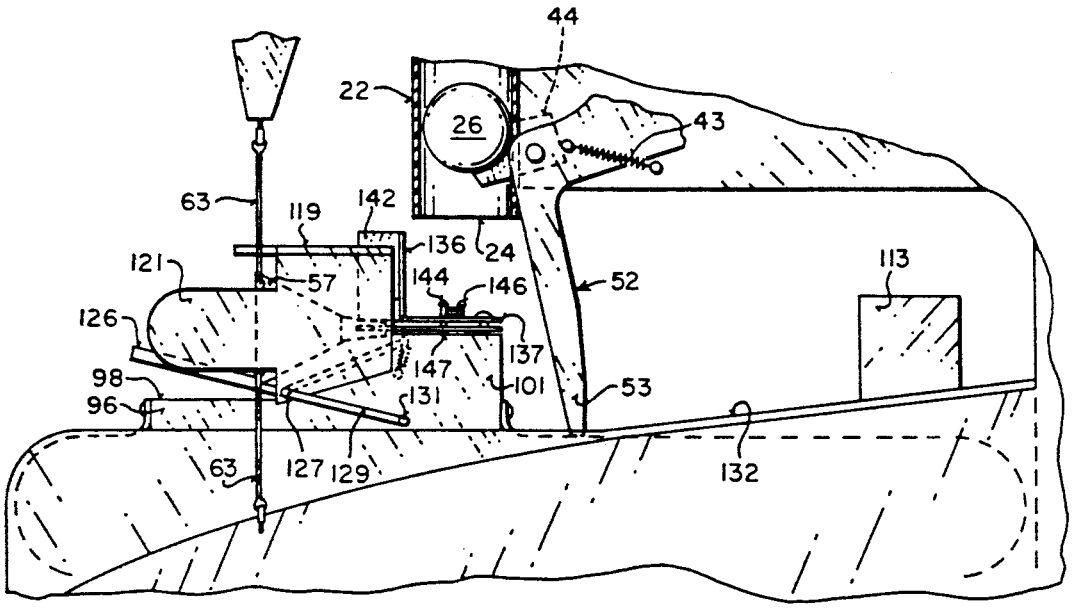
FIG. 10 is a fragmentary elevational view illustrating the relationship between an automatically retractible ball-retaining ramp and the carriage when the carriage is in its forwardmost position and the elastic bands all lie in a common plane.
Figure 11:
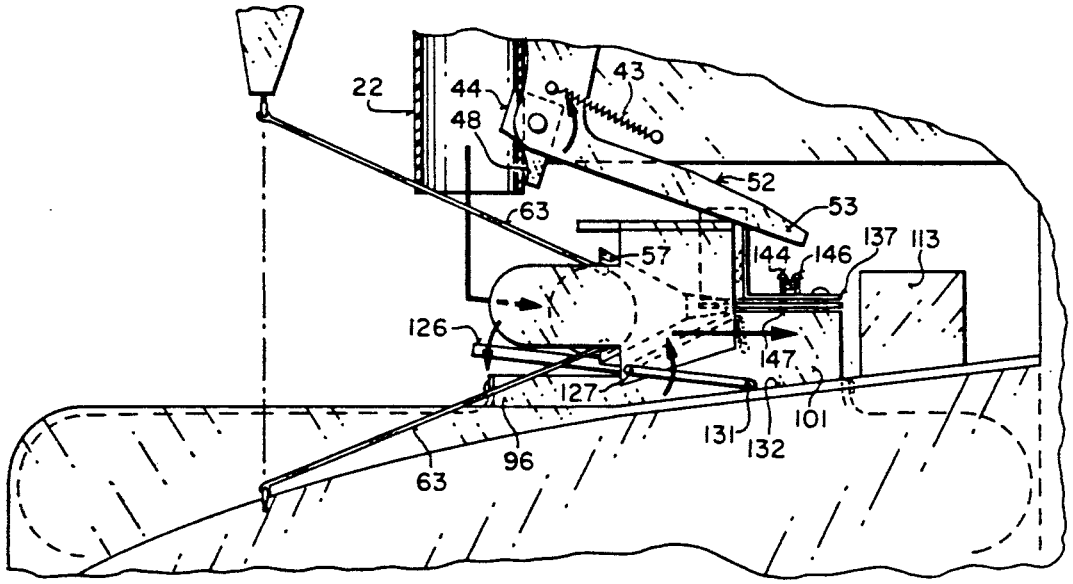
FIG. 11 is a fragmentary elevational view similar to FIG. 10 but showing the carriage approaching its rearmost position and the retractible ball-retaining ramp partially retracted.

Referring to FIGS. 7, 8 and 9, it will be seen that the hook portion 109 normally penetrates into the recess extension 103 under the impetus of a coil spring 116 (FIGS. 3, 4 and 5) which normally biases the latch assembly in a counterclockwise direction. The hook portion 109 is provided with a sloping forward edge 117 that is engaged by the rear edge of the spout 59 when the carriage moves forwardly toward the position illustrated in FIGS. 7, thus camming the arm 108 clockwise until the counterclockwise biased hook portion 109 registers with and penetrates into slot 61 formed in the spout portion 59. The sling 56 is thus releasably latched to the carriage assembly when the carriage assembly reaches its forwardmost position.

Movement of the carriage assembly rearwardly is effected by releasable engagement of the cross-pin 87, now on the upper reach of the chain, with a pair of rearwardly projecting hook members 118, spaced apart so as to straddle the chain, as shown in FIGS. 7, 8 and 9, and mounted on the carriage. As shown, when the cross-pin is elevated from the lower reach of the chain to the upper reach by passing around the sprocket 83, its engagement with the hook portion 109 is released, and the cross-pin moves rearwardly with the upper reach of the chain. When the cross-pin encounters the pair of spaced hook members 118 attached to and projecting from the carriage, the carriage is drawn rearwardly against the progressively increasing elastically resilient force imposed in the opposite direction on the carriage by the elastic bands of the sling, the conical ball-impelling member 57 of which is latched to the carriage and being drawn rearwardly with it, thus elastically stretching the elastic bands 63. Thus, the tethered relationship of the sling to the rearwardly moving carriage is maintained until the cam-follower portion 112 engages the inclined cam surface 114 of cam block 113, whereupon continued rearward movement of the cam-follower results in pivoting the arm 108 clockwise to thus extricate the hook portion 109 from its releasable engagement with the spout portion 59 of the ball-impelling member 57.

When this occurs, the ball-impelling member 57 is released from its engagement to the carriage and moves forwardly very rapidly under the impetus of the power of accommodation stored in the elastically stretched rubber bands 63. As the cone-shaped ball impeller moves forwardly, it quickly impacts with the ball 26 which has previously been released by the ball metering assembly 39, and which now rests in the ball-receiving pocket 99 as shown in the embodiment of FIGS. 5, 8 and 9. The forwardly-moving ball impeller initially encounters the ball by physical contact between the large open edge 58, which literally scoops the ball up, causing the ball to rise and nest itself in the conical impeller shell 57, the ball now centered on the central axis 36 (FIG. 6).

The acceleration of the conical ball impeller retains the ball centered on the axis 36 (FIGS. 6 and 9) until the ball impeller 57 reaches the position illustrated in FIGS. 2, 3, 4, 7, 10 and 13, whereupon the ball continues in the direction in which it is impelled, while the impeller 57, because of its inertia, is carried beyond its static position, and gradually decelerates as elastic tension increases in the elastic bands, and then returns to its static position as seen in FIGS. 3 and 4 as a consequence of stored elastic energy in the elastic bands.

It is preferable that successive balls be impelled from the device at regular intervals so that the batter may accommodate himself to the repetition rate of the device and thereby concentrate on keeping his eye on the ball and coordinating body movements, especially the arms and shoulders, to swing the bat in time to meet the ball. Accordingly, referring to FIGS. 3, 4, 5 and 6, it will be seen that successive balls are periodically released from the delivery tube by the cooperative interaction of the metering assembly 39 and the carriage assembly 66. Thus, as shown in FIG. 3, when the carriage is in its rearmost position, the tail-end portion of the control arm of the metering assembly slidably engages the upper surface 119 of the rear body portion of the carriage, and prevents a ball from entering the delivery tube. As the carriage is drawn forward by the cross-pin on the lower reach of the chain, the tail-end portion of the control arm slides off the surface 119 (FIG. 4) and pivots clockwise, admitting a ball into the inlet end of the delivery tube and interposing the metering plate 44 to prevent the ball from being delivered at this time.

Then, as the carriage moves rearwardly (FIG. 5), the rear edge of the rear block portion 101 comes into contact with the control arm 52, causing it to pivot counterclockwise, thus removing the metering plate 44 from below the ball and permitting the ball to fall by gravity into the recess or pocket 99 formed to receive it in the forwardly projecting block portion 96. Simultaneously, the head-end portion 54 of the control arm is interposed to prevent entry of the next successive ball into the inlet of the delivery tube. The carriage, with a ball now carried in the pocket and stabilized by laterally spaced stabilizer plates 121, continues rearwardly (FIG. 8) until it reaches its rearmost position (FIG. 9) whereupon the ball impeller (conical shell) is released as previously described.

It is advantageous, as practice increases proficiency, to be able to regulate the velocity to which successive balls are impelled. To accomplish this purpose, the cam block 113 may be mounted on the base by a bolt 122 slidably disposed in a slot 123 formed in the base as shown, and adjustably retained thereon by a wing-nut 124 that may selectively be loosened to effect an adjustment and tightened to retain the cam block in its new position. Moving the cam block forwardly reduces the power of accommodation stored in the elastic bands by reducing the extent of retraction of the carriage prior to release of the latch assembly, and thus reduces the force with which the balls are impelled and, as a consequence, reduces their velocity. It should also be noted that varying the extent of retraction of the carriage to control the velocity of the balls also, to some extent, varies the cyclical frequency of the device. Varying the speed of the motor may also result in varying the operating frequency of the device.

In the embodiment of the invention illustrated in FIGS. 10–14, the recess or pocket 99 into which the ball is dropped as shown in FIG. 5 has been eliminated and in its place there has been substituted a normally spring-pressed ball receiving and retaining ramp 126 pivotally mounted on the rear block portion 101 of the main body portion of the carriage by journal rods 127 on opposite sides of the block portion 101 so that the ramp projects forwardly over the surface 98 of the forwardly projecting block portion 96 (FIG. 101). The ramp 126 is normally held inclined upwardly from its pivotal journal rods so that a ball dropping on the upper surface 128 of the ramp rolls rearwardly into the conical impeller 57 and is therefore held by the impeller in position to be flung forwardly when the impeller is released as previously described.

On one side of the block portion 101 the journal rod is integral with a rearwardly projecting lever 129 parallel with the associated side of the block portion 101 and terminating in a perpendicular laterally projecting cam follower portion 131. The cam follower portion is adapted to ride up on the cam surface 132 of channel member 68 as the carriage moves rearwardly (FIG. 11), thus gradually pivoting the ramp downwardly toward surface 98 until the point of release of the impeller is reached (FIG. 12) at which time the ramp is completely lowered, thus providing a clear path for the ball to be propelled forwardly by the impeller. After the ball impeller is released and the carriage moves forwardly, the ramp is again raised by a tension spring 133 connected between the lever arm 134 and the block portion 101. This arrangement is preferred to the recess 99 because it places the ball within the open mouth of the conical impeller and retains it at more nearly the elevation at which it will be propelled along the axis line 36, thus increasing the accuracy of its trajectory.

In the embodiment of the invention illustrated in FIGS. 1–9, the impeller 57 is releasably latched to the carriage by a hook portion 109 on the end of latch arm 108. The impeller is released from the carriage by pivotal displacement of the latch arm and hook portion when the laterally projecting cam-follower 112 impinges against cam block 113. The same principle and mode of operation for release of the impeller is utilized in the embodiment of FIGS. 10–14, and substantially the same type structural elements are employed. Accordingly, the same reference numbers have been applied to corresponding elements.

When a baseball pitcher pitches a baseball, he communicates his intention to throw the ball by well recognized body movements that alert the batter to expect the throw. In a ball-hurling machine, however, there is usually no warning and the batter may not be ready to receive each ball as it is hurled. Accordingly, in the embodiment of the invention illustrated in FIGS. 10–14, there is provided a visible signal that the ball is about to be hurled, thus providing the batter with the opportunity to prepare himself to receive the ball. The visible signal is provided by a "flag" formed by a plate 136 which is moveably mounted on the carriage so that it moves from a not-so-visible position to a fully visible position just prior to release of the ball, thus alerting the batter of the impending "throw".

Figure 14:
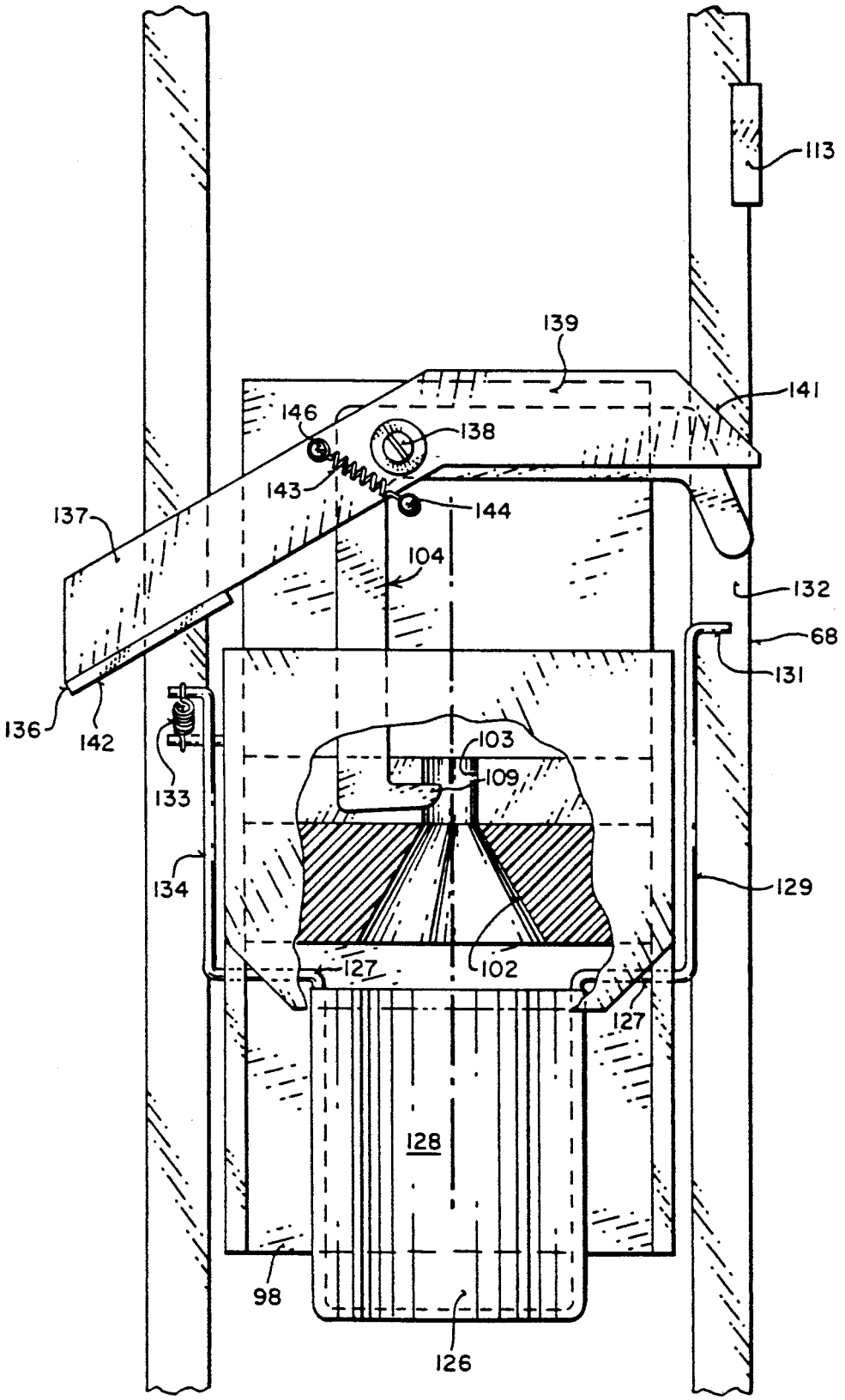
FIG. 14 is a fragmentary plan view of the carriage assembly of the embodiment illustrated in FIGS. 10–13 and showing the ramp and "flag" alert mechanism.

Referring to the drawings, particularly FIG. 14, it will there be seen that the plate 136 is mounted on arm 137 pivoted at 138 and having an extension 139 terminating in an angled edge 141 adapted to abut the cam block 113 when the carriage approaches its rearmost position. This causes the arm 137 to pivot clockwise, shifting the plate 136 so that its surface 142 is clearly visible to the batter. An instant after the "flag" is deployed, the cam follower 112 abuts the cam block 113 and trips the latch assembly 104 to release the impeller and hurl the ball. A tension spring 143 anchored at one end on pin 144 driven into the base and anchored at its opposite end on pin 146 mounted on arm 137 is resiliently tensioned when the arm pivots in a clockwise direction and returns the arm and attached plate 136 to its "inactive" position when the carriage moves forwardly after the ball is hurled. The pin 146 serves a double function. It not only forms an anchor for the spring 143, but also passes through the arm to provide an abutment 147 which moves away from the associated latch arm 108 when the "flag" is activated, and moves against or abuts the latch arm 108 to move the latch 109 into latching position after it has released the impeller.

Having thus described the invention, what is claimed and sought to be protected by letters patent of the United States is as follows:

1. A portable catapult device for automatically hurling along a central axis a succession of balls individually so that each ball after it leaves the catapult presents a moving target for batting practice, comprising:

a base member having a central axis along which a ball is adapted to be propelled;

a hopper associated with said base member for containing a multiplicity of balls to be automatically fed in succession onto said base member along said central axis to be hurled individually from the device;

a carriage mounted on said base member for controlled uniform velocity reciprocal movement alternately between first and second positions and between said second and first positions along said central axis;

means on said base member operable to effect said controlled uniform velocity reciprocal movement of said carriage initially between said first and second positions and thereafter between said second and first positions;

a sling elastically mounted on the base member and a ball-propelling member elastically supported on said base member for movement along said central axis;

at least three elastic bands supporting said ball-propelling member, inner converging ends of each of said at least three elastic bands being connected to said ball-propelling member, and opposite ends of each of said at least three elastic bands being anchored to said base member at attachment points which are symmetrical with respect to said central axis and which lie in a common plane;

means for releasably engaging said ball-propelling member with said carriage when said carriage is in said first position and for releasing said ball-propelling member from said carriage when said carriage is in said second position, said ball-propelling member when released from said carriage moving toward said first position apart from said carriage; and means on said base member operable in concert with movement of said carriage toward said second position for transferring a ball from said hopper to a position coincident with said central axis to interact with said ball-propelling member apart from said carriage when said ball-propelling member is released from said carriage at said second position, the attachment of said opposite ends of said at least three elastic bands at said symmetrical attachment points causing said ball-propelling member to travel a straight path coincident with said central axis of said base member, said ball being hurled along said central axis and from the device through a predetermined trajectory by elastic return of said ball-propelling member from said second position toward and beyond said first position, said ball-propelling member being elastically returned to said first position after separation from said ball beyond said first position.

2. The combination according to claim 1, in which means are provided for supporting a ball released from said hopper in position to interact with said ball-propelling member when it is released from said carriage.

3. The combination according to claim 2, in which said means for supporting a ball in position to interact with said ball-propelling member comprises a cradle formed on said carriage including a platen and side walls adapted to receive and retain the ball on said central axis in position to be propelled by said ball-propelling member.

4. The combination according to claim 1, in which said ball-propelling member is elastically biased toward said first position in all positions of said ball-propelling member.

5. The combination according to claim 1, in which said means operable to effect controlled uniform velocity reciprocation of said carriage includes a drive motor, a chain driven by said drive motor, and means on said chain interacting with said carriage to move said carriage alternately between said first and second positions.

6. The combination according to claim 5, in which said means on the chain interacting with said carriage includes at least one cross-pin adapted to periodically engage and disengage from said carriage.

7. The combination according to claim 1, in which a guide track is provided on said base member, and said carriage is reciprocable along said guide track.

8. The combination according to claim 7, in which said guide track comprises a pair of transversely spaced and parallel mutually facing channel members extending longitudinally of the base member, and said carriage includes a plurality of wheels rotatably engaging said channel members.

9. The combination according to claim 1, in which said means on said carriage adapted to engage said ball-propelling member comprises a latch arm pivotally mounted on said carriage and normally biased in a ball-propelling member-engaging direction, and means operatively associated with said latch arm to actuate the latch arm to disengage said ball-propelling member when said carriage is in said second position.

10. The combination according to claim 9, in which said means for actuating said latch arm comprises an inclined cam surface adapted to be slidably engaged by said latch arm when said carriage is moved to said rearmost second position.

11. The combination according to claim 1, in which said ball-propelling member includes a hollow truncated conical shell having a large base facing in the direction of said first position and a relatively smaller diameter base facing in the direction of said second position, and said at least three elastic bands engage said conical shell at said large base to connect said conical shell to said base member so that said elastic bands lie in said common plane when said ball-propelling member is at said first position.

12. The combination according to claim 1, in which means are provided on said carriage operable to signal the impending propulsion of the ball by said sling.

13. The combination according to claim 12 in which said means for signaling impending propulsion of the ball comprises a plate movable from a not-so-visible position to a position clearly visible by a batter just prior to propulsion of the ball.

14. The combination according to claim 12, in which said means for signaling impending propulsion of the ball includes a spring-pressed lever arm pivotally mounted on the carriage and normally resiliently retained in a first position during the interval that the carriage moves from said first position toward said second position and then just prior to said carriage attaining said second position pivots to a second position, and a plate mounted on the spring-pressed lever arm and movable by said lever arm from a not-so-visible position to a visible position just prior to said carriage attaining said second position at which position said impeller is released to fling the ball.

15. The combination according to claim 1, in which said means on the base member operable in concert with movement of the carriage to position a ball coincident with said central axis includes a ramp assembly including a ramp normally inclined rearwardly to impel said ball into said ball-propelling member prior to release of said ball-impelling member from said carriage.

16. The combination according to claim 15, in which said ramp assembly is mounted on said carriage and includes a normally rearwardly inclined surface onto which a ball is transferred from said hopper as said carriage moves toward and approaches said second position, a control lever connected to said normally rearwardly inclined surface and including a cam follower portion, an inclined cam surface on the base member adapted to be engaged by said cam follower as said carriage approaches said second position, whereby said normally rearwardly inclined surface on which a ball is situated is pivoted into a horizontal position just prior to release of a ball to provide a clear path for delivery of the ball by said sling.

17. The combination according to claim 16, in which said normally rearwardly inclined surface of said ramp assembly is spring-pressed to normally resiliently retain the inclined ramp inclined rearwardly until just prior to propulsion of said ball.

18. A portable catapult device for hurling a succession of balls individually so that each ball presents a moving target for batting practice, comprising:

a) a base member;

b) a hopper associated with the base member for containing a multiplicity of balls to be hurled individually from the device;

c) a carriage reciprocably mounted on the base member for controlled movement between first and second positions;

d) a sling elastically mounted on the base member and engageable with said carriage when said carriage is in said first position and releasable from said carriage when said carriage is in said second position;

e) means on said base member operable to effect controlled reciprocation of said carriage initially between said first and second positions and thereafter between said second and first positions; and f) means on the base member operable in concert with movement of said carriage toward said second position for transferring a ball from said hopper to a position to interact with said sling when it is released from said carriage whereby said ball is hurled from the device through a predetermined trajectory by elastic return of said sling from said second position toward and beyond said first position, said sling being elastically returned to said first position after separation from said ball beyond said first position;

g) said means on the base operable in concert with movement of said carriage for transferring a ball from said hopper to a position to interact with said sling when released comprises a ball delivery chute having a ball inlet end associated with said hopper and adapted to receive one ball at a time from said hopper, ball metering means pivotally mounted on the base and including a metering arm projecting into said ball delivery chute to selectively retain a ball therein or release a ball therefrom and a lever pivotally depending into the path of said carriage when the carriage moves toward said second position and connected to said metering arm projecting into said ball delivery chute whereby upon a predetermined movement of said carriage toward said second position from said first position said metering means releases a ball for passage past said metering arm, platen means on the carriage moveable therewith to receive a ball released by said metering arm and to retain the ball in the outlet end of the ball delivery chute while said carriage continues to move for a predetermined distance toward said second position whereby when said platen moves said predetermined distance with said carriage support for the released ball is removed and the ball falls by gravity into position to interact with said sling when released.

* * * * *